US006738587B1

(12) United States Patent
Hoene et al.

(10) Patent No.: US 6,738,587 B1
(45) Date of Patent: May 18, 2004

(54) SYSTEMS AND METHODS FOR PRINT RECOMMENDATION AND CONTROL

(75) Inventors: Keith Hoene, Boise, ID (US); D. Travis Lay, Horseshoe Bend, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/304,043

(22) Filed: Nov. 25, 2002

(51) Int. Cl.[7] ..... G03G 21/14

(52) U.S. Cl. ..... 399/77; 399/82; 399/85; 358/1.14

(58) Field of Search ..... 399/77, 81, 82, 399/83, 85, 87; 358/1.14, 1.15

(56) References Cited

U.S. PATENT DOCUMENTS 5,287,194 A * 2/1994 Lobiondo ..... 358/296

* cited by examiner

*Primary Examiner*—Hoang Ngo

(57) ABSTRACT

Disclosed are systems and methods for print recommendation and control. In one embodiment, a system and method pertain to analyzing print job parameters, determining whether any of the print job parameters are impermissible, and interrupting the print job if one or more print job parameters is determined to be impermissible. In another embodiment, a system and method pertain to analyzing print job parameters, determining if one or more print job parameters is likely to create an adverse printing outcome, and if it is determined that an adverse printing outcome is likely, notifying the user as to the likelihood of the adverse printing outcome and providing an alternative print recommendation to the user.

21 Claims, 7 Drawing Sheets

SYSTEMS AND METHODS FOR PRINT RECOMMENDATION AND CONTROL

BACKGROUND

Printing devices, for instance printers, require driver software that executes on the print data originating device, for instance a personal computer (PC), that acts like a translator between the printing device and the user applications that generate the print data. Each printing device has its own set of specialized commands that only its driver understands. The driver software accepts generic commands from the user application and then translates them into specialized commands for the printing device.

The driver software, as well as the user application, may be used to select various different print settings or options that the user can choose for print jobs. For instance, the user can choose the type of media that will be used, the resolution the generated document will have, reduced-toner (i.e., "economode") printing, etc. Typically, these settings are adjusted with a user interface of the printing device driver or user application from which the print data originates.

Although allowing greater flexibility to the user in creating print jobs, adjustment of print settings can adversely affect the printing results. In particular, users may not be aware that the selections they have made may adversely affect particular print jobs. For example, if the driver software is set to an economode setting, photographic images printed by the printing device may be of poor quality. To cite another example, where the user is printing data using a large page format (e.g., A3 size) and the selected print media is relatively smaller (e.g., letter size), not all of the print data may be printed and/or the document formatting will be incorrect. In general, sychronization does not always occur between the print driver settings and the printing device capabilities.

In that the user often does not understand why poor print results occur in such circumstances, the user may be dissatisfied or frustrated at the print outcome. For instance, if the user has adjusted a print setting that, unbeknownst to the user, will reduce print quality and then prints a large presentation document, the user is likely to be disappointed with the print result as well as with the prospect of having wasted time, print media, and toner.

In other situations, the user may not encounter such print problems, but may create an adverse situation for another entity. For example, in the enterprise space, it may be company policy to limit the size or number of pages for print jobs sent to a given printing device to avoid tying up and/or wasting company resources. In that there normally is no way of controlling such printing practices, however, such rules may not be observed by all.

SUMMARY

Disclosed are systems and method for print recommendation and control. In one embodiment, a system and method pertain to analyzing print job parameters, determining whether any of the print job parameters are impermissible, and interrupting the print job if one or more print job parameters is determined to be impermissible.

In another embodiment, a system and method pertain to analyzing print job parameters, determining if one or more print job parameters is likely to create an adverse printing outcome, and if it is determined that an adverse printing outcome is likely, notifying the user as to the likelihood of the adverse printing outcome and providing an alternative print recommendation to the user.

BRIEF DESCRIPTION OF THE DRAWINGS

The systems and methods disclosed herein can be better understood with reference to the following drawings. The components in the drawings are not necessarily to scale.

DETAILED DESCRIPTION

As noted above, printing device users may make printing choices that either adversely affect the print outcome and/or that may offend an employer's or other provider's printing policies. As is described in greater detail below, where the printing device driver is configured to recognize choices that will result in poor print results the user can be alerted to this fact and provided with recommendations that, if implemented, will result in a better outcome. In addition, where the printing device driver is configured to recognize choices that go beyond the bounds of permissible printing practices, the print job may be interrupted so as to provide greater control over the printing practices of printing device users.

Disclosed are embodiments of systems and methods for print recommendation and control. To facilitate description of the systems and methods, example systems are first discussed with reference to the figures. Although these systems are described in detail, these systems are provided for purposes of illustration only and various modifications are feasible. Examples of operation of the systems are provided to explain the manners in which print recommendation and control may be facilitated.

Figure 1:
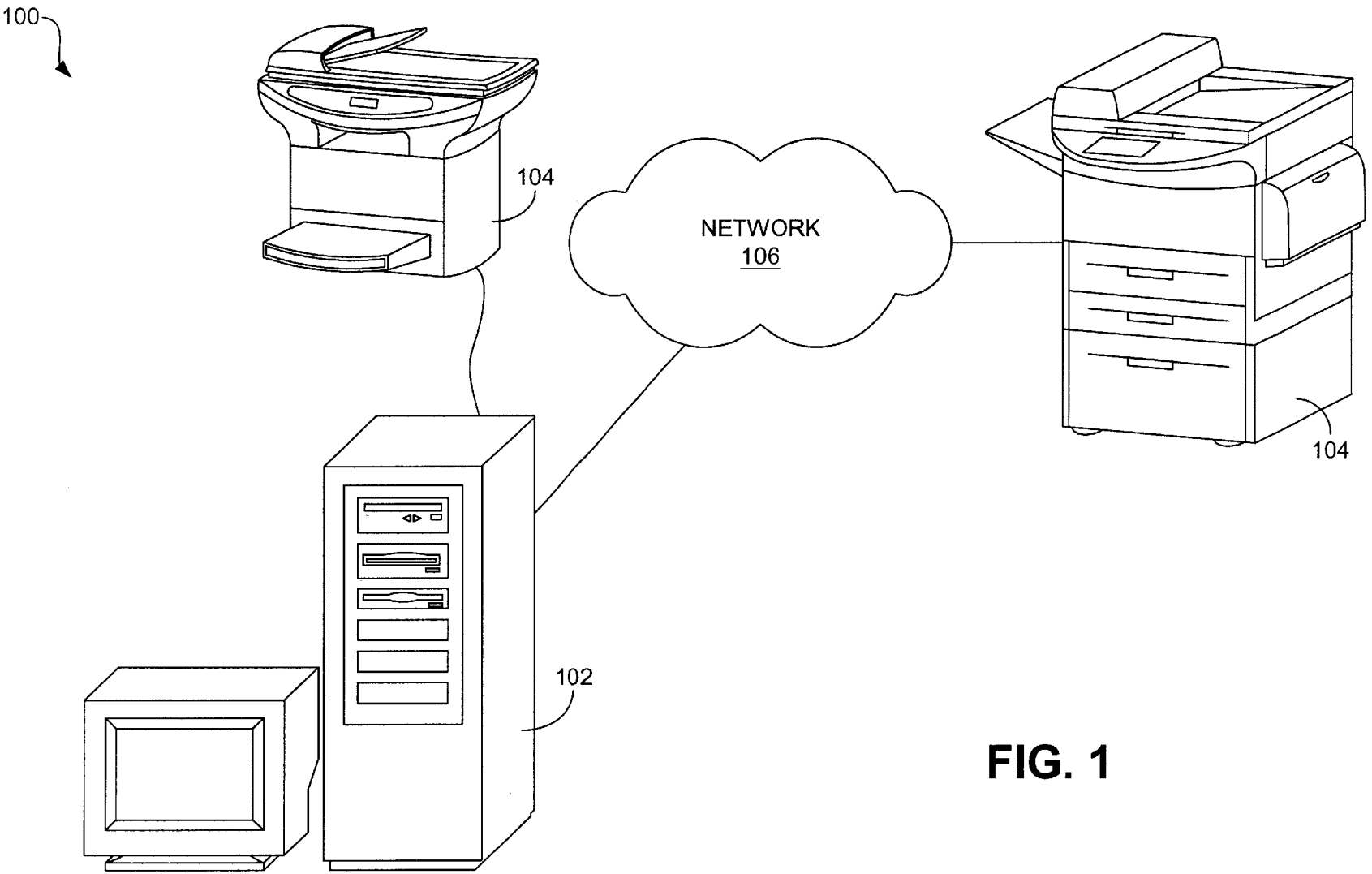
FIG. 1 is a schematic view of an embodiment of a system with which print recommendation and control can be facilitated.

Referring now in more detail to the drawings, in which like numerals indicate corresponding parts throughout the several views, FIG. 1 illustrates an example system 100. The system 100 generally comprises a computing device 102 and one or more printing devices 104. As indicated in FIG. 1, the computing device 102 can comprise a personal computer (PC). More generally, however, the computing device 102 comprises any device that is capable of accessing and using the printing devices 104 and, more particularly, which is capable of communicating with the printing devices by transmitting data to and/or receiving data from the printing devices. Therefore, by way of example, the computing device 102 can comprise a PC, Macintosh™, notebook computer, server, handheld computing device (e.g., personal digital assistant (PDA), mobile telephone), etc.

The printing devices 104 can comprise, for example, a local printer, or a shared network printer. More generally, however, the printing devices comprise any device that is capable of generating hardcopy documents from print data including photocopiers, facsimile machines, multi-function peripheral (MFP) devices, etc.

Where the printing device 104 is a shared network printer, the computing device 102 can, optionally, be connected to a network 106 that typically comprises one or more sub-networks that are communicatively coupled to each other. By way of example, these networks can include one or more local area networks (LANs) and/or wide area networks (WANs). Indeed, in some embodiments, the network 106 may comprise a set of networks that forms part of the Internet. Alternatively, however, the computing device 102 can be directly connected to a printing device 104. Such an arrangement is likely in a home environment in which the user does not have a home network or in an office environment where the printing device 104 is used as a convenience printer.

Figure 2:
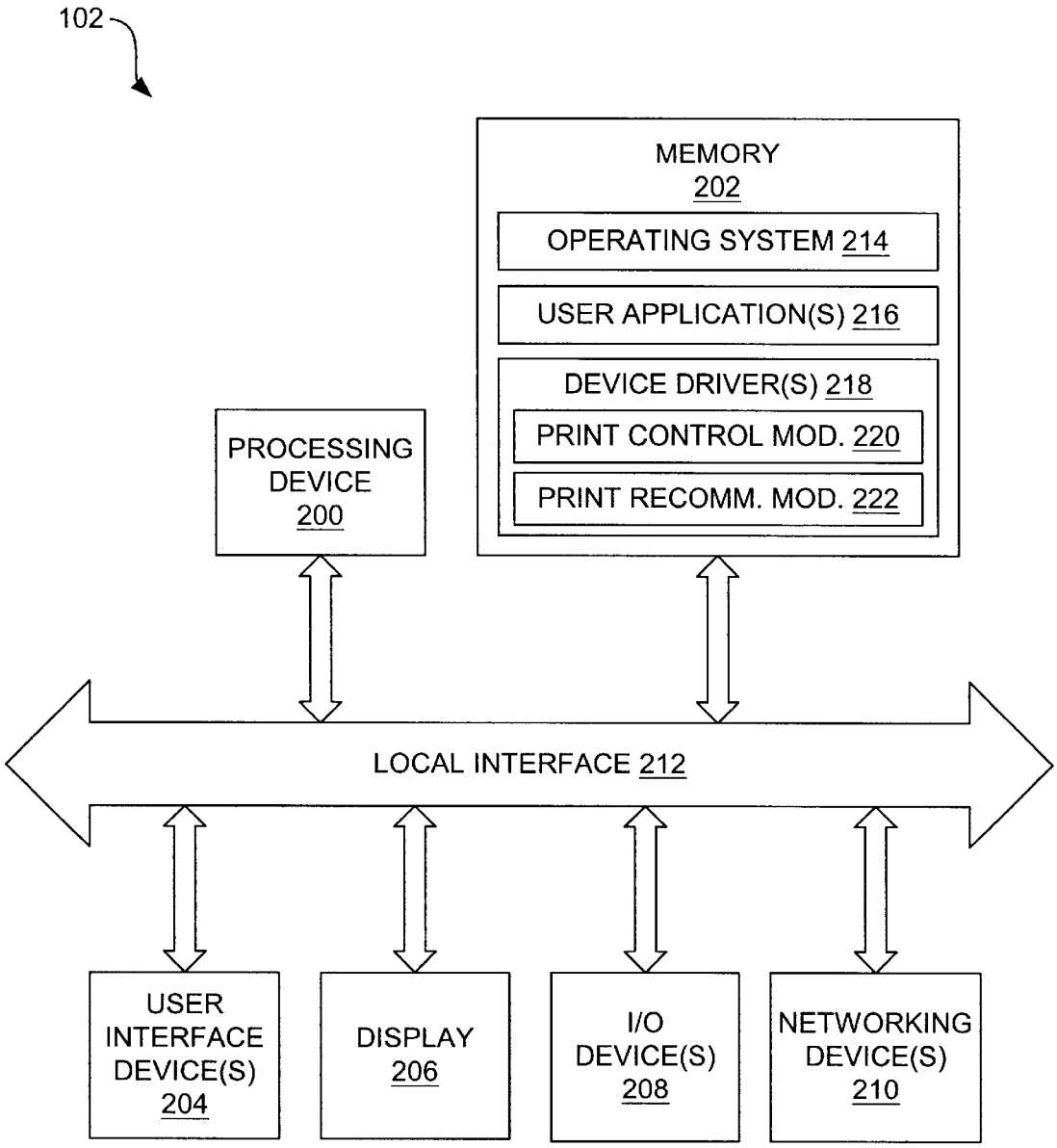
FIG. 2 is a block diagram of an embodiment of a computing device shown in FIG. 1.

FIG. 2 is a schematic view illustrating an example architecture for the computing device 102 shown in FIG. 1. As indicated in FIG. 2, the computing device 102 can comprise a processing device 200, memory 202, one or more user interface devices 204, a display 206, one or more input/output (I/O) devices 208, and one or networking devices 210, each of which is connected to a local interface 212 that can comprise one or more internal and/or external buses. The processing device 200 can include any custom made or commercially available processor, a central processing unit (CPU) or an auxiliary processor among several processors associated with the computing device 102, a semiconductor based microprocessor (in the form of a microchip), or a macroprocessor. The memory 202 can include any one of a combination of volatile memory elements (e.g., random access. memory (RAM, such as DRAM, SRAM, etc.)) and nonvolatile memory elements (e.g., ROM, hard drive, tape, CDROM, etc.).

The user interface devices 204 comprise those components with which the user can interact with the computing device 102. By way of example, these components comprise a keyboard and mouse. Where the computing device 102 is a handheld device (e.g., PDA, mobile telephone), these components can comprise function keys or buttons, a touch-sensitive screen, etc. The display 206 can comprise a cathode ray tube (CRT) or liquid crystal display (LCD) monitor, or screen for a handheld device.

With further reference to FIG. 2, the I/O devices 208 are adapted to facilitate connection of the computing device 102 to another device, such as a printing device 104, and may therefore include one or more serial, parallel, small computer system interface (SCSI), universal serial bus (USB), and/or IEEE 1394 (e.g., Firewire™) components. The networking devices 210 comprise the various components used to transmit and/or receive data over the network 106. By way of example, the networking devices 210 include a device that can communicate both inputs and outputs, for instance, a modulator/demodulator (e.g., modem), wireless (e.g., radio frequency (RF)) transceiver, a telephonic interface, a bridge, a router, network card, etc.

The memory 202 stores various programs (software and/or firmware) including an operating system 214, one or more user applications 216, and one or more printing device drivers 218. The operating system 214 controls the execution of other programs and provides scheduling, input-output control, file and data management, memory management, and communication control and related services. The user applications 216 comprise applications that execute on the computing device 102 and which can be used to access and use the printing devices 104. By way of example, the user applications 216 can include various source applications that are used to create, modify, and/or identify data to be transmitted to a printing device 104. For instance, the user applications 216 can include a word processing application, an image manager, etc.

The one or more drivers 218 comprise software and/or firmware that is used to translate data output or identified by the user applications 216 into a format (i.e., language) which is suitable for the printing devices 104. Although shown as being provided in the memory 202 of the computing device 102, the one or more drivers 218 can be located on another device, such as a network print server (not shown) or a printing device 104, if desired. The drivers 218 normally include one or more applications which comprise user interfaces (e.g., graphical user interfaces (GUIs)) with which the user can input selections or commands to the drivers. As indicated in FIG. 2, one or more of the device drivers 218 includes a print control module 220 and a print recommendation module 222. As described in greater detail below, these modules analyze the print job parameters and, respectively, provide the ability to control printing (e.g., by interrupting print jobs) and provide recommendations as to print jobs, depending upon the parameters that are observed.

Various programs have been described herein. These programs can be stored on any computer-readable medium for use by or in connection with any computer-related system or method. In the context of this document, a computer-readable medium is an electronic, magnetic, optical, or other physical device or means that can contain or store a computer program for use by or in connection with a computer-related system or method. These programs can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the instruction execution system, apparatus, or device.

The computer-readable medium can be, for example but not limited to, an electronic, magnetic, optical, electromagnetic, infrared, or semiconductor system, apparatus, device, or propagation medium. More specific examples (a nonexhaustive list) of the computer-readable medium include an electrical connection having one or more wires, a portable computer diskette, a random access memory (RAM), a read-only memory (ROM), an erasable programmable read-only memory (EPROM, EEPROM, or Flash memory), an optical fiber, and a portable compact disc read-only memory (CDROM). Note that the computer-readable medium can even be paper or another suitable medium upon which a program is printed, as the program can be electronically captured, via for instance optical scanning of the paper or other medium, then compiled, interpreted or otherwise processed in a suitable manner if necessary, and then stored in a computer memory.

Example systems having been described above, operation of the systems will now be discussed. In the discussions that follow, flow diagrams are provided. Any process steps or blocks in these flow diagrams may represent modules, segments, or portions of code that include one or more executable instructions for implementing specific logical functions or steps in the process. Although particular example process steps are described, alternative implementations are feasible. Moreover, steps may be executed out of order from that shown or discussed, including substantially concurrently or in reverse order, depending on the functionality involved.

Figure 3:
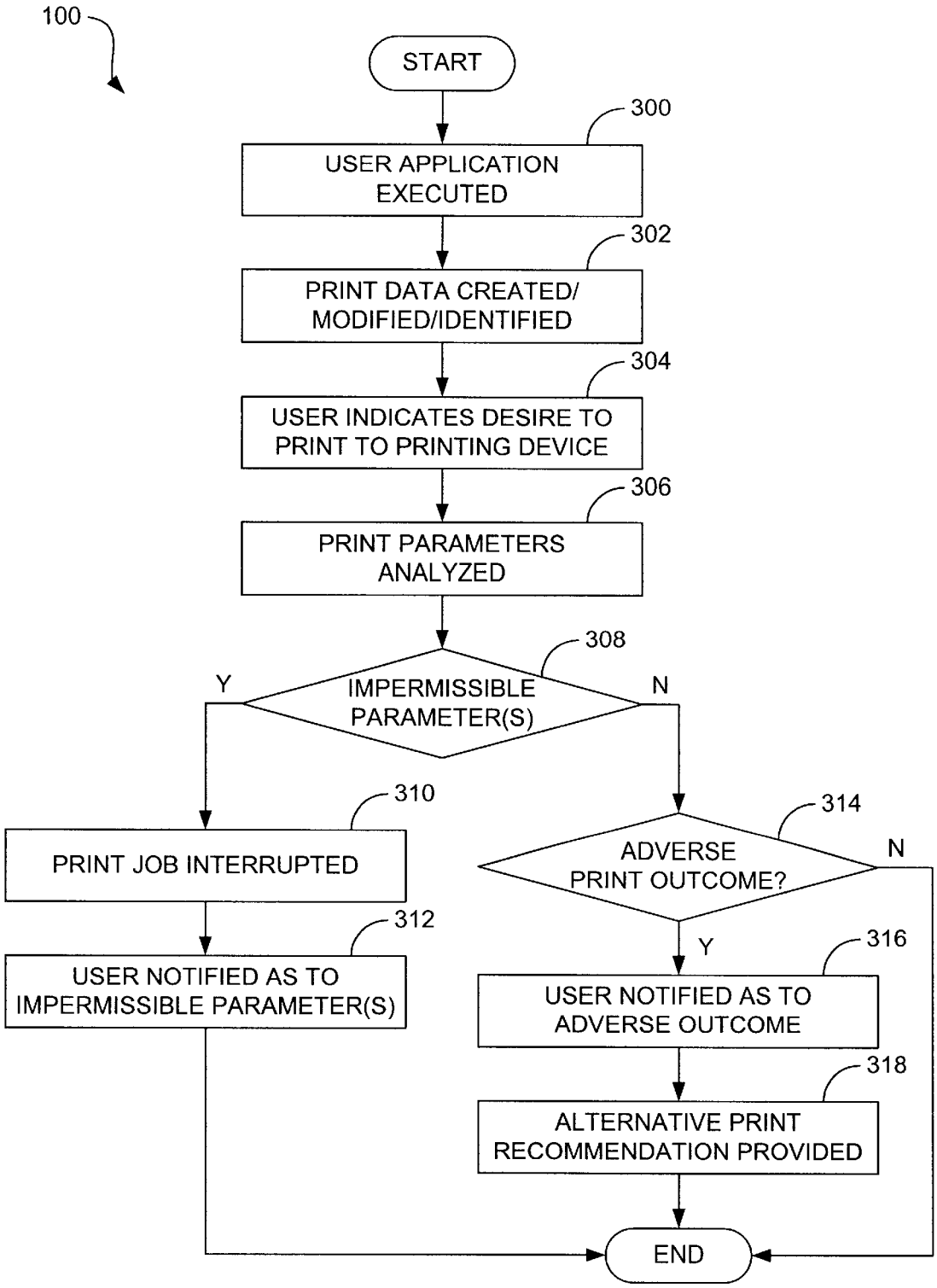
FIG. 3 is a flow diagram that provides an embodiment of use of the system shown in FIG. 1 in facilitating print recommendation and control.

As discussed above, printing device drivers can be used to both recommend alternative print settings where the currently selected settings may have an adverse outcome on the print job, as well as prevent impermissible printing practices. FIG. 3 provides an overview of this functionality with an example of use of the system 100. Beginning with block 300, a user application 216 is executed on the computing device 102. As noted above, this user application comprises any application that can be used to create, modify, or identify print data. Next, print data is created, modified, and/or identified using the user application 216, as indicated in block 302. For instance, the user can have typed text within a word processing application or identified one or more images that the user would like to print with an image manager.

At this point, the user indicates that he or she would like to print some print data using a particular printing device, as indicated in block 304, by, for example, selecting a "print" command from the user application. The print parameters are then analyzed, as indicated in block 306. In particular, the print job is analyzed to determine what print settings have been selected, as well as to determine whether anything about the print job is not permitted in view of pre-established print parameters. Next, with reference to decision block 308, it is determined whether the print job comprises one or more impermissible parameters. If so, the print job is interrupted, as indicated in block 310, and the user is notified as to the impermissible parameter(s), as indicated in block 312.

With reference back to decision block 308, if no print parameter is impermissible, flow continues to block 314 at which it is determined whether an adverse outcome is likely to occur due to one or more print parameters. If no adverse print outcome is deemed likely, the print process may proceed and flow for this portion of the system 100 is terminated. If, on the other hand, an adverse print outcome is considered likely due to the print parameters, flow continues to block 316 at which the user is notified as to the likely adverse print outcome and, as indicated in block 318, provided with one or more alternative print recommendations.

Figure 4:
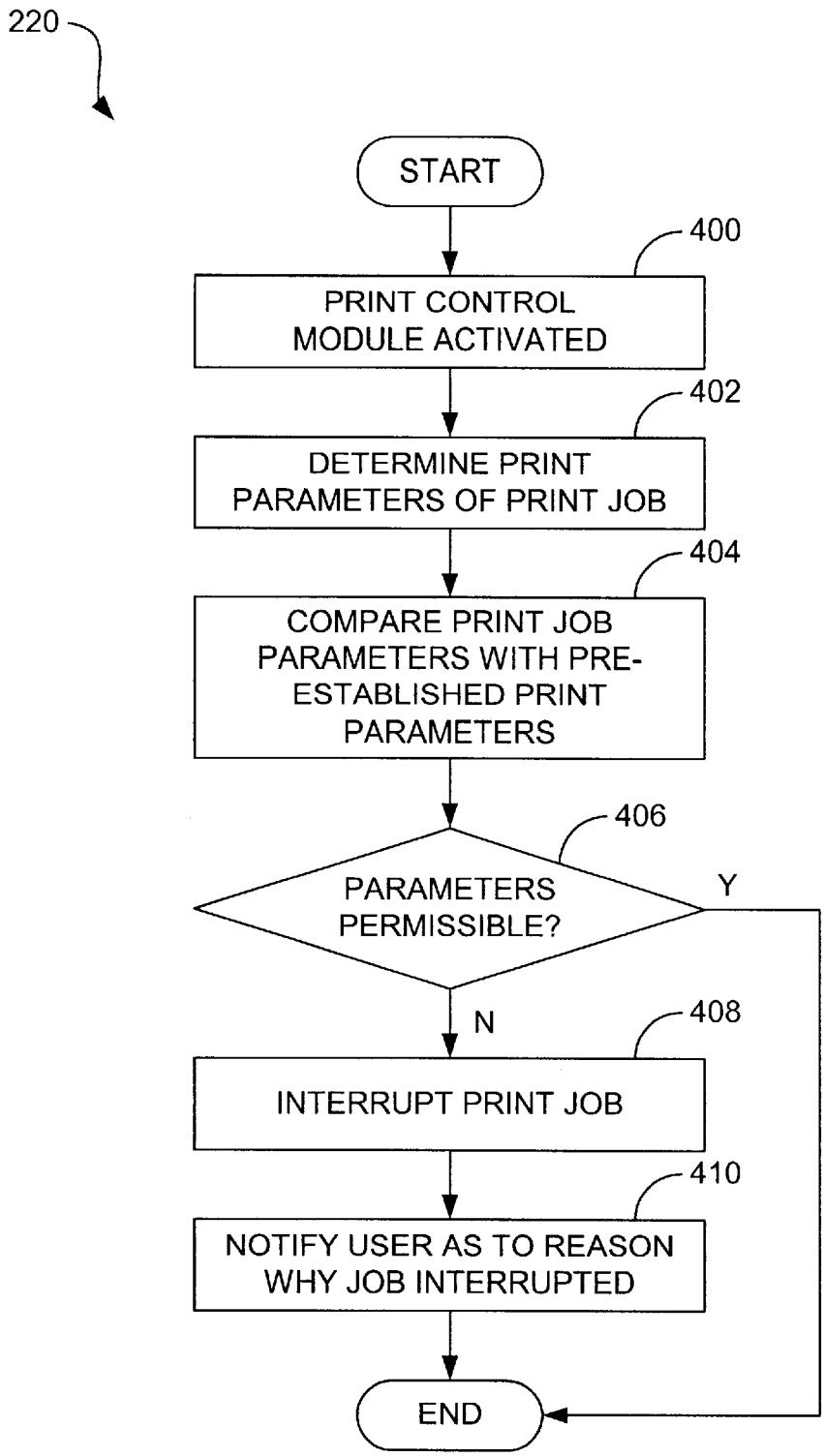
FIG. 4 is a flow diagram that illustrates an embodiment of operation of a print control module shown in FIG. 2 in providing print control.

FIG. 4 provides an example of operation of the print control module 220 illustrated in FIG. 2. Beginning with block 400, the control module 220 is activated. This activation can occur in a variety of ways. By way of example, the user can have selected a "print" command in a "file" menu or a "print" button from the user application GUI. In any case, the control module 220 then determines the print parameters of the print job that is to be delivered to the printing device, as indicated in block 402.

The nature of the print parameters to be determined depends upon the manner in which the print control module 220 has been set configured. For example, the control module 220 can determine the number of pieces of media (e.g., paper) the job will require, the file size of the print job, the type of media to be used, the amount of toner or ink that will be consumed, the type of finishing (e.g., stapling, folding) that will be used to finish the print job, etc. More generally, the print parameters that are determined may pertain to any parameter that is desired to be controlled. In the typical scenario, the parameters pertain to resource usage within a concern such as a enterprise. Therefore, the parameters may be determined to conserve such resources (e.g., paper, toner, ink, staples, network bandwidth, etc.).

Referring next to block 404, the various determined print parameters are compared with pre-established print parameters. In the enterprise space, the pre-established print parameters may have been set by a responsible administrator such as an information technology (IT) professional. By way of example, these pre-established parameters may be stored within a look-up table that is stored locally on the user's computing device, or stored within a centralized location such as a network print server.

Once the comparison has been made between the print parameters of the user's print job and the pre-established print parameters, the print control module 220 determines whether the parameters of the print job are permissible, as indicated in decision block 406. If so, the print job is acceptable, and printing may continue. In such a case, flow for the print control module 220 in this print session is terminated. If, on the other hand, one or more print parameters of the print job is impermissible, flow continues to block 408 and the print job is interrupted. Due to this interruption, the print job is not forwarded to the printing device by the driver 218 so that the impermissible action will not take place. The user is then notified as to the reason why the print job has been interrupted, as indicated in block 410. By way of example, the user may be notified with an appropriate pop-up dialog box.

Figure 5:
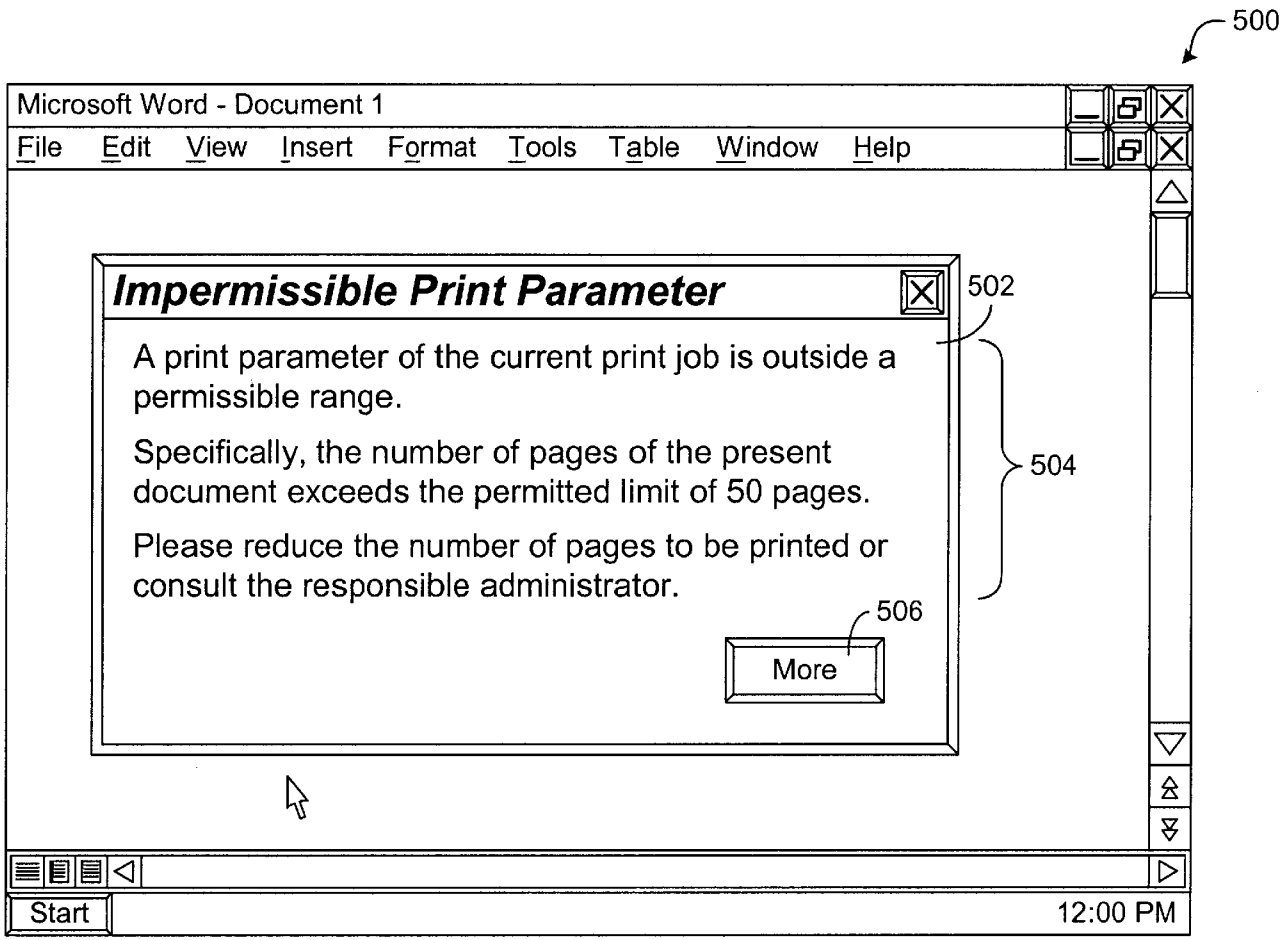
FIG. 5 illustrates an example of a print notification regarding an impermissible print parameter.

FIG. 5 illustrates an example of notifying a user as to an impermissible print job. More specifically, FIG. 5 illustrates a user application GUI 500 in which a dialog box 502 has been presented to the user. In the example of FIG. 5, the user application comprises a word processing application and, more particularly, Microsoft Word™. Although this particular user application has been identified, this application is used for purposes of illustration only.

As indicated in FIG. 5, the dialog box 502 can include text 504 that identifies that the print job comprises an impermissible print parameter. In the example of FIG. 5, the text 504 communicates to the user that the number of pages of the document to be printed exceeds the maximum limit that has been set for that user (i.e., 50 pages). The text further instructs the user to either reduce the number of pages of the document or consult an administrator, for example to see if an exception can be granted for that particular print job. In addition, the dialog box 502 includes a button 506 (or other selectable feature) with which the user can obtain more information.

Figure 6:
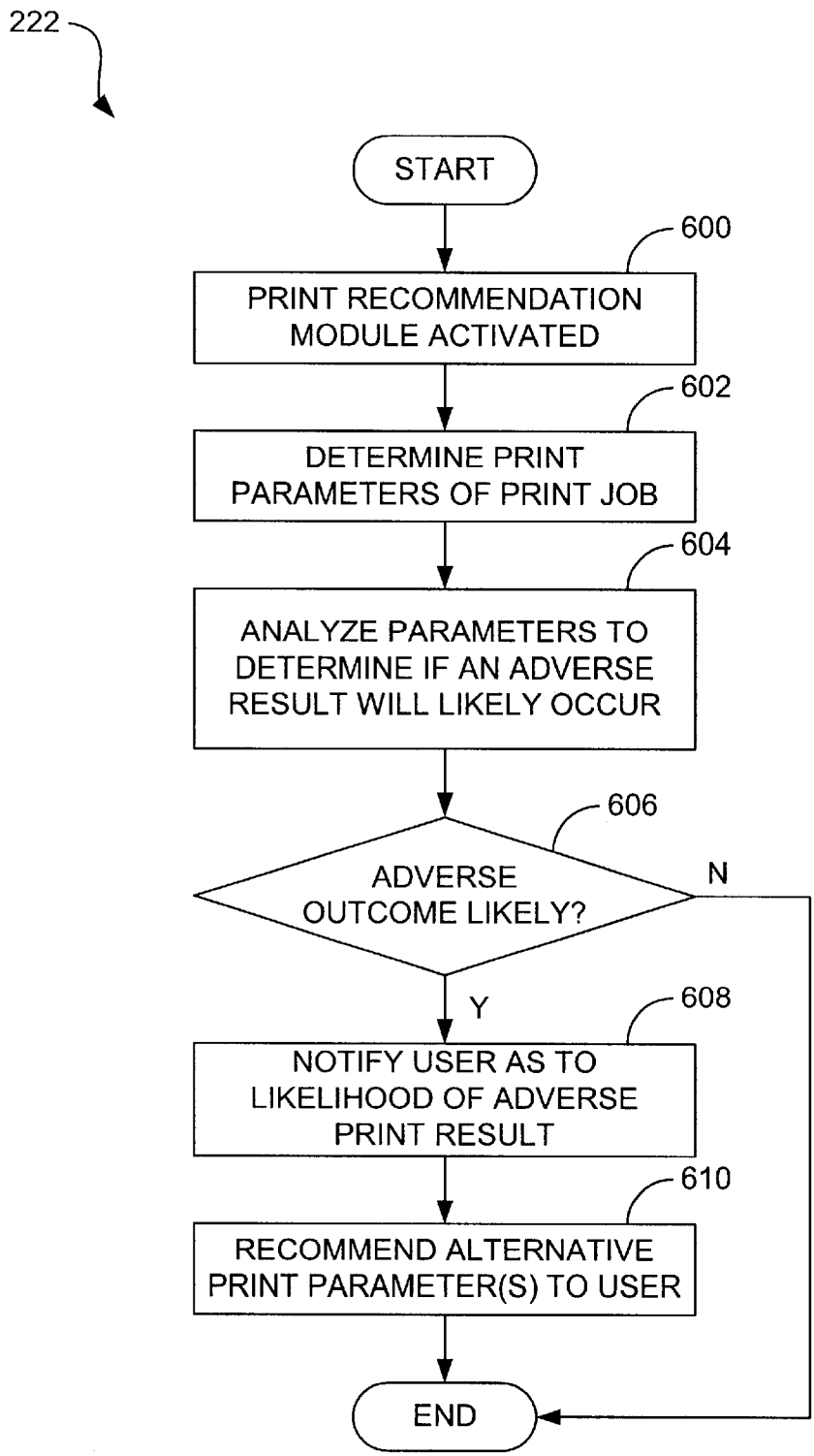
FIG. 6 is a flow diagram that illustrates an embodiment of operation of a print recommendation module shown in FIG. 2 in providing a print notification and recommendation.

FIG. 6 provides an example of operation of the print recommendation module 222 illustrated in FIG. 2. Beginning with block 600, the recommendation module 222 is activated. Again, this activation can have occurred in response to the user having selected a "print" command. Once activated, the recommendation module 222 determines the print parameters of the print job that is to be delivered to the printing device, as indicated in block 602. In this case, however, the print parameters are determined for the purposes of improving print quality by preventing adverse print results that the user may not be aware will occur. The print parameters may therefore pertain to document attributes such as the size of the document "pages" (e.g., letter, A4, etc.), the number of pages of the document, and the colors used in the document and/or may pertain to printing device driver settings and printing device capabilities such as the size of the print media selected, the type of finishing selected, the current toner-usage selection (e.g., economode versus normal), the finishing capabilities of the printing device (e.g., folding, stapling), etc. In some embodiments, the determination of the print parameters can further comprise analysis of the print data contained within the print job. For instance, the print data can be analyzed by an appropriate algorithm of the print recommendation module 222 to determine whether the print data is merely text, or includes image data (e.g., graphics, photographs), whether the data is monochromatic or multi-colored, etc.

Once the various print parameters have been determined, the print parameters are analyzed to determine whether an adverse print result is likely to occur as indicated in block 604. The nature of this analysis depends upon the print parameters that were observed. For example, if it was determined that the document to be printed contains pantone colors, but the driver 218 is set to an economode in which less toner is used, it can be assumed that an undesirable print result will occur. In another example, if the document comprises A4 "pages," but a tray containing letter-sized media is currently selected in the device driver, an adverse print result may be presumed. In a further example, if the user has selected to staple the document, but the number of pages of the document will exceed the maximum number of pages that can be stapled by the printing device, an unacceptable print result may be presumed. As can be appreciated by these examples, the print recommendation module 222 may be configured to identify substantially any mismatch between any print job parameter and the current driver setting(s) and/or the capabilities of the printing device.

With reference next to decision block 606, if an adverse print outcome is not likely, acceptable results presumably will be achieved and the print job may be sent, as is, to the printing device. In such a case, flow for the print recommendation module 222 is terminated. If, however, an adverse print outcome is likely, flow continues to block 608 and the user is notified as to the likelihood of the adverse print result. In addition, the print recommendation module 222 may recommend one or more alternative print parameters to the user, as indicated in block 610, so that more acceptable print results can be obtained.

The nature of the recommendations provided to the user depend upon the adverse print result that is likely to occur. For example, where there is a mismatch between the size of the "pages" of the document and the size of the printing device media that has been selected, the print recommendation module 222 may recommend reconfiguring the document pages and/or reselecting the printing device media so that the print data will fit within the print media. To cite another example, where the number of pages exceeds the amount that may be stapled by the printing device, the print recommendation module 222 may recommend using pre-punched media instead of stapling so that the media can be instead bound in an appropriate ring binder. Alternatively, the print recommendation module 222 could instead recommend using another size of print media. For example, where the document is formatted for letter-sized media but too many pages to staple would result, the print recommendation module 222 could suggest using ledger-sized print media so that two "pages" of the document could be printed on each actual media sheet. If this is done, the document may be made into a booklet, thereby reducing the total number of sheets in half and, potentially, making stapling feasible. In yet another example, where the document contains pantone colors, but economode printing is selected, the print recommendation module 222 could recommend changing the toner-usage selection to a "normal" setting.

Figure 7:
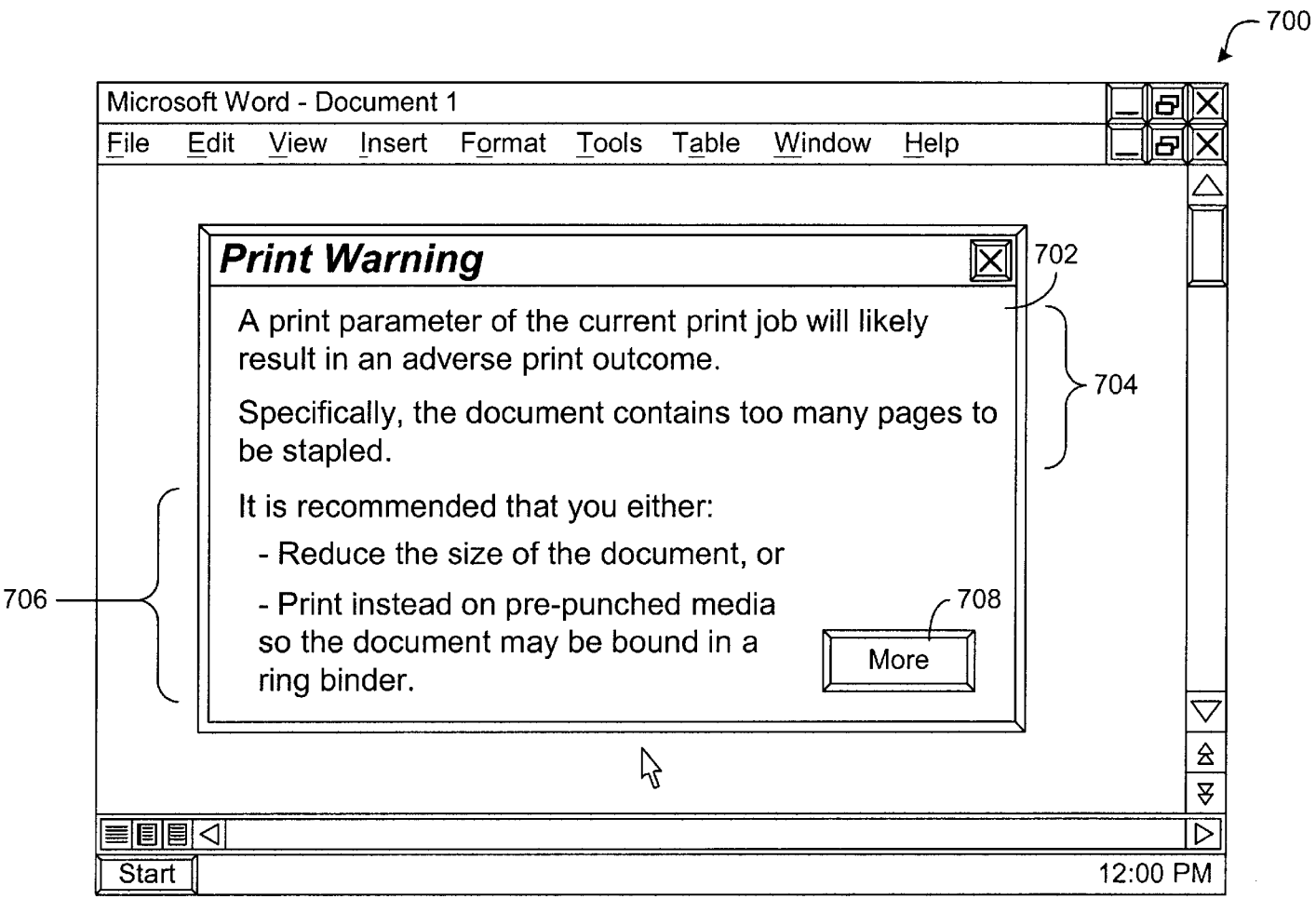
FIG. 7 illustrates an example of a print notification and recommendation provided to a user.

As in the case of the print control module 220 described above with reference to FIG. 4, the user may be notified with a dialog box. FIG. 7 illustrates an example of notifying a user as to an adverse print result, and providing an alternative print recommendation. Again, illustrated is a user application GUI 700 in which a dialog box 702 has been presented to the user. As indicated in FIG. 7, the dialog box 702 includes text 704 that identifies that one or more print parameters will likely result in an adverse print outcome. In the example of FIG. 7, the text 704 communicates to the user that the number of pages of the document is too large to staple. In addition, the dialog box includes text 706 that provides a recommendation to the user. Recommended is reducing the size of the document (so that stapling can still be performed) or printing the document on pre-punched paper so that the document can be bound in a ring binder. As is further indicated in FIG. 7, a button 708 (or other selectable feature) can be provided within the dialog box 702 to obtain more details as to the adverse result and/or to obtain more detail about the recommendations, or obtain other recommendations, if any.

Operating in the manner described above, the printing device driver 218 can be used to prevent undesired printing results, whether they pertain to user printing in a manner that is deemed impermissible or they pertain to unacceptable print quality.

What is claimed is:

1. A method for controlling user printing, comprising:

analyzing print job parameters by determining parameters that pertain to resource usage;

determining whether any of the print job parameters are impermissible in view of pre-established parameters for a printing location at which printing is to occur; and interrupting the print job if one or more print job parameters is determined to be impermissible so as to limit resource usage at the location.

2. The method of claim 1, wherein the step of analyzing print job parameters comprises determining at least one of the number of pieces of media the job will require, the file size of the print job, the type of media to be used, the amount of toner or ink that will be consumed, and the type of finishing that will be used to finish the print job.

3. The method of claim 1, wherein the step of interrupting the print job comprises preventing the print job from being delivered to a selected printing device.

4. The method of claim 1, further comprising notifying a user as to the reason why the print job is considered to be impermissible.

5. A system for controlling user printing, comprising:

logic configured to analyze parameters of a print job to be delivered to a given printing device;

logic configured to determine whether any of the print job parameters are outside of a permissible range in view of pre-established print parameters that have been set at a location at which printing is to occur; and logic configured to interrupt delivery of the print job to the printing device if a print job parameter is determined to be outside the permissible range.

6. The system of claim 5, further comprising logic configured to notify a user as to the reason why the print job is considered to be impermissible.

7. A method for preventing an adverse printing outcome, comprising:

analyzing print job parameters;

determining if one or more print job parameters is likely to have an adverse effect on print quality; and if it is determined that an adverse effect on print quality is likely, notifying the user as to the likelihood of the adverse effect and providing an alternative print recommendation to the user.

8. The method of claim 7, wherein the step of analyzing print job parameters comprises analyzing at least one of a document attribute and a printing device driver setting.

9. The method of claim 7, wherein the step of analyzing print job parameters comprises one of determining the size of the document pages, the number of pages of the documents, and the colors used in the document.

10. The method of claim 7, wherein the step of determining comprises determining if one or more print job parameters is likely to have an adverse effect in view of at least one of a printing device setting and a capability of a selected printing device.

11. The method of claim 7, wherein the step of providing an alternative print recommendation comprises providing at least one of a recommendation to change a document attribute and a recommendation to change a printing device driver setting.

12. A system for preventing an adverse printing outcome, comprising:

logic configured to analyze parameters of a print job to be delivered to a given printing device;

logic configured to, in view of at least one of printing device driver settings and printing device capabilities, determine if any of the print job parameters is likely to have an adverse effect on print quality; and logic configured to provide an alternative print recommendation to a user.

13. The system of claim 12, wherein the logic configured to provide comprises logic configured to provide at least one of a recommendation to change a document attribute and a recommendation to change a printing device driver setting.

14. A printing method, comprising:

analyzing print job parameters;

determining whether any of the print job parameters are impermissible;

if any print job parameter is impermissible, interrupting the print job so that it is not sent to a printing device;

if no print job parameter is impermissible, determining if one or more print job parameters is likely to have an adverse effect on print quality; and if it is determined that an adverse effect on print quality is likely, notifying the user as to the likelihood of the adverse effect and providing an alternative print recommendation to the user.

15. A printing device driver stored on a computer-readable medium, comprising:

a print control module configured to analyze print job parameters and determine whether any of the parameters is impermissible in view of pre-established print parameters that pertain to resource usage; and a print recommendation module configured to analyze print job parameters and determine whether any of the parameters would likely have an adverse effect on print quality.

16. The driver of claim 15, wherein the print control module is further configured to prevent the print job from being delivered to an intended printing device.

17. The driver of claim 16, wherein the print control module is further configured to notify a user as to the discovered impermissible parameter.

18. The driver of claim 15, wherein the print recommendation module is further configured to notify a user if an adverse effect on print quality is likely.

19. The driver of claim 15, wherein the print recommendation module is further configured to recommend alternative print parameters.

20. The driver of claim 19, wherein the print recommendation module is further configured to provide a recommendation related to at least one of a document attribute and a driver setting.

21. A system for controlling printing, comprising:

means for identifying print job parameters that pertain to resource usage;

means for comparing the print job parameters to pre-established print parameters that pertain to resource usage for a location at which printing is to occur;

means for determining whether any of the print job parameters are impermissible in view of the comparison; and means for interrupting the print job if one or more print job parameters is determined to be impermissible.

* * * * *